US010221790B2

(12) United States Patent
Yanagawa et al.

(10) Patent No.: US 10,221,790 B2
(45) Date of Patent: Mar. 5, 2019

(54) CONTROLLING APPARATUS FOR ENGINE

(71) Applicant: MITSUBISHI JIDOSHA KOGYO KABUSHIKI KAISHA, Tokyo (JP)

(72) Inventors: Kensuke Yanagawa, Otsu (JP); Nozomu Nakamura, Kyoto (JP); Fumiaki Hiraishi, Kyoto (JP); Masayuki Yamashita, Kyoto (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 161 days.

(21) Appl. No.: 15/246,911

(22) Filed: Aug. 25, 2016

(65) Prior Publication Data

US 2017/0058807 A1 Mar. 2, 2017

(30) Foreign Application Priority Data

Aug. 26, 2015 (JP) ..... 2015-166467

(51) Int. Cl.
*F02D 35/02* (2006.01)
*F02D 41/04* (2006.01)
*F02D 41/14* (2006.01)

(52) U.S. Cl.
CPC ..... *F02D 41/047* (2013.01); *F02D 35/023* (2013.01); *F02D 35/025* (2013.01);
(Continued)

(58) Field of Classification Search
CPC .... F02D 41/047; F02D 35/025; F02D 35/023; F02D 41/1458; F02D 35/028;
(Continued)

(56) References Cited

U.S. PATENT DOCUMENTS

2014/0053808 A1* 2/2014 Nakasaka ..... F02D 13/0238 123/406.12
2017/0009687 A1* 1/2017 Yamano ..... F02P 5/152

FOREIGN PATENT DOCUMENTS

JP 62-131961 A 6/1987
JP 2010-84619 A 4/2010

OTHER PUBLICATIONS

Rudloff J, Zaccardi JM, Richard S, Anderlohr JM. Analysis of pre-ignition in highly charged SI engines: emphasis on the auto-ignition mode. Proc Combust Inst 2013;34:2959-67.*
(Continued)

*Primary Examiner* — Joseph J Dallo
*Assistant Examiner* — Scott A Reinbold
(74) *Attorney, Agent, or Firm* — Birch, Stewart, Kolasch & Birch, LLP

(57) ABSTRACT

A controlling apparatus for an engine, includes: an auto-ignition index calculating unit that is configured to calculate, based on a cylinder temperature and a cylinder pressure in a combustion chamber, an auto-ignition index which indicates easiness of occurrence of auto-ignition of fuel at a crank angle before an ignition timing in a compression stroke; a first correction coefficient calculating unit that is configured to calculate, based on an amount of fuel adhering to a wall surface of the combustion chamber at the crank angle, a wall-adhering fuel correction coefficient for correcting the auto-ignition index; and a low-speed pre-ignition predicting unit that is configured to predict, based on the auto-ignition index and the wall-adhering fuel correction coefficient, occurrence of low-speed pre-ignition.

10 Claims, 3 Drawing Sheets

(52) U.S. Cl.
CPC ..... *F02D 35/028* (2013.01); *F02D 41/1458* (2013.01); *F02D 2200/021* (2013.01); *F02D 2200/0406* (2013.01); *F02D 2200/0414* (2013.01)

(58) Field of Classification Search
CPC ..... F02D 2200/0406; F02D 2200/021; F02D 2200/0414
USPC ..... 123/435
See application file for complete search history.

(56) References Cited

OTHER PUBLICATIONS

Rudloff J, Zaccardi JM, Richard S, Anderlohr JM. Analysis of pre-ignition in highly charged SI engines: emphasis on the auto-ignition mode. Proc Combust Inst 2013;34:2959-67. (Year: 2013).*

* cited by examiner

FIG. 3A

| WATER TEMPERATURE \ INJECTION TIMING | 300 | 270 | 240 | 210 | 180 |
|---|---|---|---|---|---|
| 90 | a | a | b | c | e |
| 80 | b | b | c | d | f |
| 70 | c | c | e | e | g |
| 60 | e | e | f | g | i |
| 50 | g | g | h | i | j |
| 40 | i | i | j | k | l |
| 30 | k | k | l | m | n |

FIG. 3B

| AMOUNT OF FUEL ADHERING TO WALL SURFACE (mg) | 5 | 10 | 15 | 20 | 25 | 30 |
|---|---|---|---|---|---|---|
| CORRECTION COEFFICIENT | a | c | e | g | i | k |

FIG. 3C

| RATE OF RECIRCULATION GAS (%) | 2.0 | 4.0 | 6.0 | 8.0 | 10.0 | 12.0 |
|---|---|---|---|---|---|---|
| CORRECTION COEFFICIENT | a | v | w | x | y | z |

CONTROLLING APPARATUS FOR ENGINE

CROSS-REFERENCE TO RELATED APPLICATION(S)

This application is based upon and claims the benefit of priority from prior Japanese patent application No. 2015-166467, filed on Aug. 26, 2015, the entire contents of which are incorporated herein by reference.

BACKGROUND

The present invention relates to a controlling apparatus for an engine including an exhaust gas recirculation apparatus, and more particularly to an engine controlling apparatus which predicts occurrence of low-speed pre-ignition that occurs under low-speed and high-load conditions.

Many engines mounted on vehicles include an exhaust gas recirculation apparatus. An exhaust gas recirculation apparatus recirculates part of exhaust gas that is discharged from a combustion chamber of an engine toward the atmosphere through an exhaust passage, into an intake passage, whereby the combustion temperature in the combustion chamber is lowered, and emission of nitrogen oxides (NOx) contained in the exhaust gas is suppressed.

A technique is available in which an exhaust gas recirculation apparatus reduces abnormal combustion in a combustion chamber of an engine by using exhaust gas recirculated into an intake passage (hereinafter, such exhaust gas is referred to as "recirculation gas").

In the technique disclosed in JP-A-62-131961, for example, an outlet leading to an intake passage for recirculation gas is placed in the vicinity of a combustion chamber, and the direction of the outlet is set so that the recirculation gas introduced into the combustion chamber flows along the inner peripheral wall of a cylinder. The recirculation gas which swirls in the combustion chamber along the inner peripheral wall of the cylinder forms an annular recirculation gas layer in a portion near the inner peripheral wall. In a middle portion of the combustion chamber where a spark plug is placed, therefore, the exhaust gas concentration is relatively lowered to enhance and the ignition performance, and, in an outer peripheral portion of the combustion chamber, a phenomenon which is so-called "knocking," and in which the exhaust gas concentration in the vicinity of the inner peripheral wall of the cylinder is raised, and the end gas is auto-ignited is prevented from occurring.

JP-A-2010-84619 discloses a technique in which occurrence of pre-ignition is predicted by using a prediction formula called the Livengood-Wu integral expression.

Usual pre-ignition is caused by a phenomenon in which deposit accumulated in a combustion chamber is peeled off from the wall surface of a cylinder, and then exposed to combustion to glow, and the glowing deposit becomes the source of auto-ignition. On the other hand, it is said that low-speed pre-ignition is caused by above-described deposit or another phenomenon in which droplets of lubricating oil scattering from the inner peripheral wall of a cylinder ignite in accordance with a temperature rise of the interior of a combustion chamber, and then the droplets function as pilot fire to cause a gas mixture to auto-ignite.

As a technique for preventing usual pre-ignition from occurring, a technique in which the ignition timing is delayed is employed. On the other hand, examples of a technique for preventing low-speed pre-ignition from occurring are a technique in which the intake air temperature is lowered, and that in which the oxygen concentration in the gas mixture is reduced. When the technique in which the intake air temperature is lowered is employed, however, there is a case where a significant output reduction is caused depending on driving conditions. When, in the configuration of JP-A-62-131961, the amount of the recirculation gas introduced into the intake air is increased in order to reduce the oxygen concentration in the gas mixture, for example, the temperature in the combustion chamber is raised, and therefore there may occur an opposite case where pre-ignition is induced. Consequently, there is a limit to the increase of the introduction amount of the recirculation gas.

In the pre-ignition prediction which is described in JP-A-2010-84619, based on whether the auto-ignition index based on factors of the cylinder pressure and temperature in the compression stroke exceeds a predetermined threshold or not, it is determined whether pre-ignition occurs before the ignition timing, i.e., the ignition target crank angle or not.

In the prediction formula, however, the amount of fuel adhering to the inner peripheral wall of a cylinder, and the introduction amount of the recirculation gas are not considered, and therefore there may arise a case where occurrence of low-speed pre-ignition cannot be correctly predicted.

SUMMARY

It is an object of the invention to predict more surely occurrence of low-speed pre-ignition in a combustion chamber.

In order to achieve the object, according to an aspect of the invention, there is provided a controlling apparatus for an engine, the engine that includes: a piston accommodated in a cylinder; an intake valve disposed in an opening of an intake passage which communicates with a combustion chamber of the cylinder; an exhaust valve disposed in an opening of an exhaust passage which is drawn out from the combustion chamber; a fuel injection valve which is configured to inject fuel into the combustion chamber or the intake passage; and an ignition unit disposed in the combustion chamber, the controlling apparatus comprising: an auto-ignition index calculating unit that is configured to calculate, based on a cylinder temperature and a cylinder pressure in a combustion chamber, an auto-ignition index which indicates easiness of occurrence of auto-ignition of fuel at a crank angle before an ignition timing in a compression stroke; a first correction coefficient calculating unit that is configured to calculate, based on an amount of fuel adhering to a wall surface of the combustion chamber at the crank angle, a wall-adhering fuel correction coefficient for correcting the auto-ignition index; and a low-speed pre-ignition predicting unit that is configured to predict, based on the auto-ignition index and the wall-adhering fuel correction coefficient, occurrence of low-speed pre-ignition.

BRIEF DESCRIPTION OF THE DRAWINGS

FIGS. 3A to 3C are map diagrams which are used in the control in the invention.

DETAILED DESCRIPTION OF EXEMPLARY EMBODIMENTS

Figure 1:
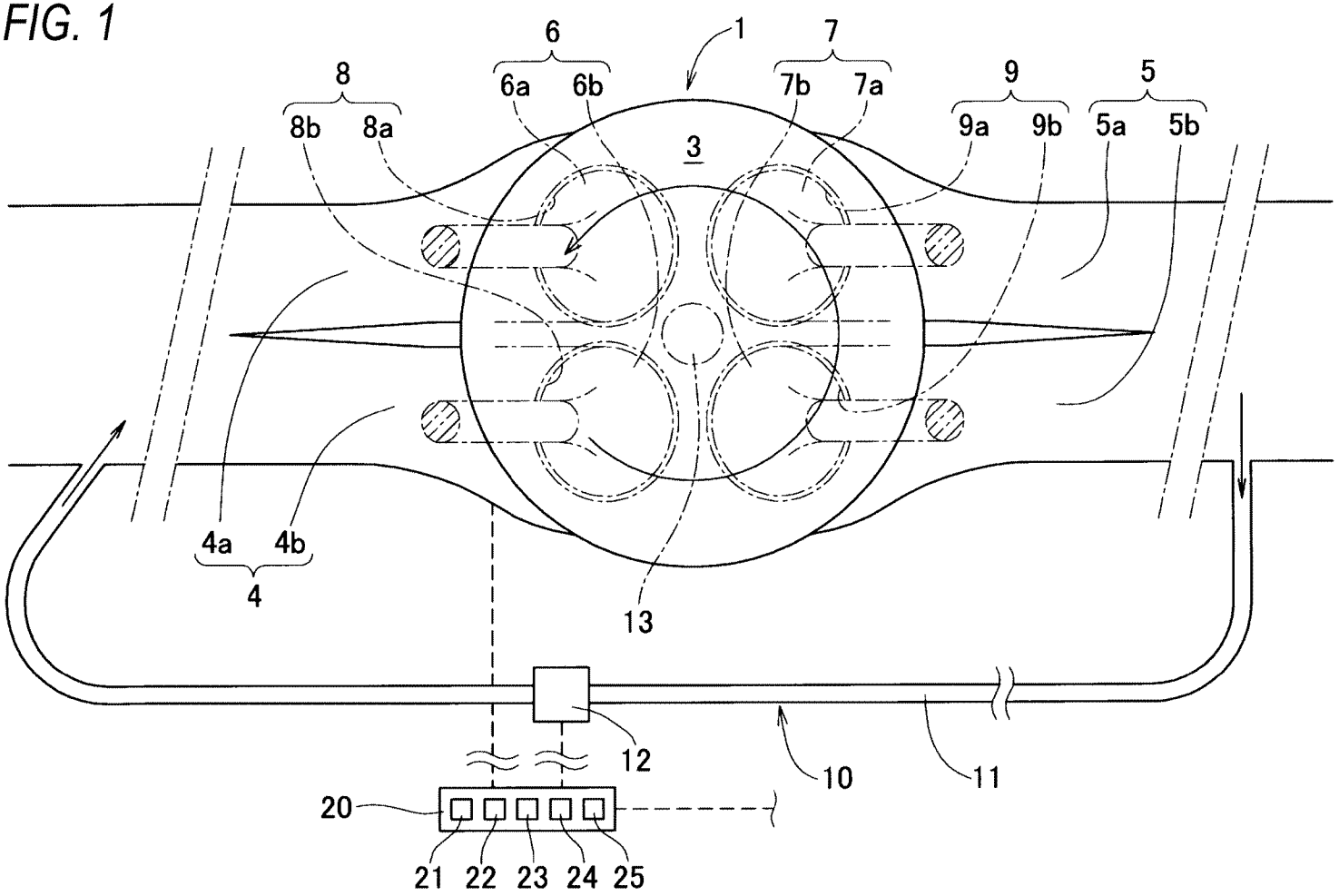
FIG. 1 is an enlarged plan view of portions of an engine.

An embodiment of the invention will be described with reference to the drawings. FIG. 1 is an enlarged plan view showing portions of a cylinder 1 of an engine.

Figure 2:
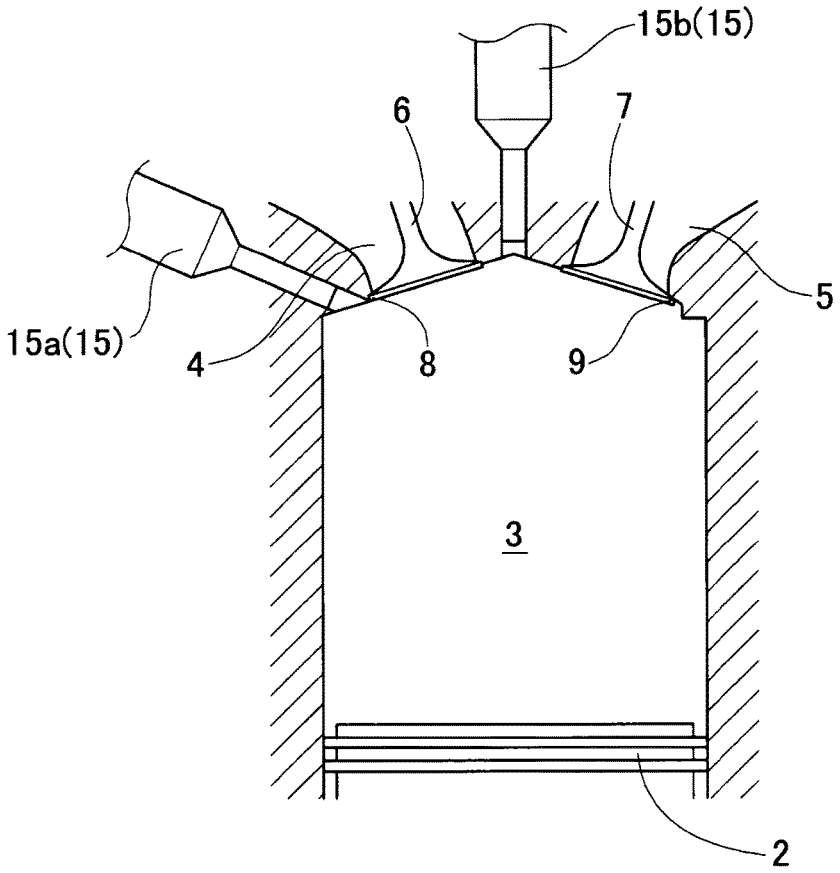
FIG. 2 is a longitudinal sectional view showing an intake state of a combustion chamber.

The engine in the embodiment is a supercharged four-cycle gasoline engine for an automobile. As shown in FIGS. 1 and 2, a piston 2 is accommodated in the cylinder 1 of the engine. A combustion chamber 3 is formed by the inner surface of the cylinder 1, the upper surface of the piston 2, and the like.

The engine includes: an intake passage 4 through which the intake air is supplied into the combustion chamber 3 of each cylinder accommodating the piston 2; an exhaust passage 5 which is led out from the combustion chamber 3; a fuel injection valve 15 which injects fuel into the combustion chamber 3; and the like. As an ignition unit 13, a spark plug is provided to be downwardly directed along the axis of the cylinder from the side of the cylinder head (see FIG. 1).

Theses figures focus on members and means which directly relate to the invention, and other members and the like are not shown. Although the single cylinder 1 is shown in the drawings, the engine may be a single cylinder engine or a multi-cylinder engine having a plurality of cylinders.

In front of the combustion chamber 3, the intake passage 4 of each cylinder branches off into two intake passages 4*a*, 4*b*. As the exhaust passage 5 which is led out from the combustion chamber 3, two exhaust passages 5*a*, 5*b* are led out, and then join together on the downstream side.

Intake valve ports 8(8*a*, 8*b*) which are openings of the intake passages 4*a*, 4*b* in the combustion chamber 3 are opened and closed by respective intake valves 6(6*a*, 6*b*). Exhaust valve ports 9(9*a*, 9*b*) which are openings of the exhaust passages 5*a*, 5*b* in the combustion chamber 3 are opened and closed by exhaust valves 7(7*a*, 7*b*), respectively.

The intake valves 6 and the exhaust valves 7 are connected to a camshaft which is disposed on the side of the cylinder head, through valve lifters, and therefore caused to open or close the intake valve ports 8 and the exhaust valve ports 9 at predetermined timings by rotation of the camshaft. The power transmission to the camshaft is performed by coupling together a sprocket disposed on the side of the camshaft and that disposed on the side of a crankshaft by means of a timing chain or the like.

The engine further includes a variable valve timing mechanism. By the control of the variable valve timing mechanism, the intake valves 6 can be set so that the opening and closing timings of the one intake valve 6*a* are different from those of the other intake valve 6*b*, and the exhaust valves 7 can be set so that the opening and closing timings of the one exhaust valve 7*a* are different from those of the other exhaust valve 7*b*. Alternatively, the intake valves and the exhaust valves may be set so that the opening and closing timings of the one intake valve 6*a* are identical with those of the other intake valve 6*b*, and the opening and closing timings of the one exhaust valve 7*a* are identical with those of the other exhaust valve 7*b*.

Furthermore, a normal opening/closing mode in which all of the two intake valves 6 and the two exhaust valves 7 are opened and closed, and a partial opening/closing mode in which one of the two intake valves 6, and one of the two exhaust valves 7 are opened and closed, and the other valves are not subjected an opening/closing operation can be selectively set by the control of the variable valve timing mechanism.

The intake valves 6, the exhaust valves 7, the variable valve timing mechanism, the ignition unit 13, the fuel injection valve 15, and other devices required for operating the engine are controlled through cables by controlling means included in an electronic control unit 20. The electronic control unit 20 which is a controlling apparatus is formed as an LSI device in which a CPU (microprocessor), an ROM, an RAM, etc. are integrated, or as an embedded electronic device. The electronic control unit 20 is provided with a control program as software in order to perform various kinds of control including engine control.

The intake passage 4 and the exhaust passage 5 communicate with each other through a recirculation gas passage 11 which constitutes an exhaust gas recirculation apparatus 10. The exhaust gas recirculation apparatus 10 has a function of recirculating part of the exhaust gas which is to be exhausted from the engine, as recirculation gas from the exhaust passage 5 which is downstream of a turbine (not shown) to the intake passage 4 which is upstream of a compressor (not shown).

The recirculation gas passage 11 includes a recirculation gas controlling unit 12 which can open and close the flow path to adjust the amount of the gas passing through the recirculation gas passage 11.

In accordance with the pressure state in the intake passage 4 which is produced by the control of the recirculation gas controlling unit 12, and the control on a throttle valve (not shown) disposed in the intake passage 4, and the like, part of the exhaust gas which is to be exhausted from the engine is recirculated in a required amount as recirculation gas to the intake passage 4 through the recirculation gas passage 11. Also these controls are performed by the electronic control unit 20 depending on driving conditions.

As the fuel injection valve 15, as shown in FIG. 2, two direct injection valves which directly inject the fuel into the combustion chamber 3 are provided for each cylinder 1.

In the vicinity of a connecting portion between the cylindrical wall surface (inner peripheral wall) of the combustion chamber 3 and the ceiling surface on the side of the cylinder head, one fuel injection valve 15*a* is disposed so that the injection port of the valve is directed obliquely downwardly. The other injection valve 15*b* is disposed in an apex portion of the combustion chamber 3 while being downwardly directed along the axial direction of the cylinder 1.

During a period when the piston 2 accommodated in the combustion chamber 3 is located close to the top dead center, the fuel injected from the one fuel injection valve 15*a* is directed to the top surface of the piston 2, and, during a period when the piston 2 is located close to the bottom dead center, directed to the wall surface of the combustion chamber 3. During period when the piston 2 accommodated in the combustion chamber 3 is moved from the top dead center to the bottom dead center, the other fuel injection valve 15*b* is always directed to the top surface of the piston 2.

In the invention, in view of the situation where one of causes of occurrence of pre-ignition is a phenomenon in which, for example, droplets of lubricating oil scattering from the cylindrical wall surface of the cylinder 1 ignite in accordance with a temperature rise of the interior of the combustion chamber 3, and then the droplets function as pilot fire to cause the gas mixture to auto-ignite, occurrence of low-speed pre-ignition is predicted in accordance with the status in the combustion chamber 3, and a control for avoiding the occurrence is performed. In the invention, moreover, the status of fuel attachment to the wall surface of the combustion chamber 3, the ratio of the recirculation gas in the intake air, and the like are considered in the prediction of occurrence of low-speed pre-ignition, and a more accurate prediction is realized.

Hereinafter, a method of predicting occurrence of low-speed pre-ignition, and a low-speed pre-ignition avoiding control which is performed in the case where occurrence of low-speed pre-ignition is predicted will be described.

The electronic control unit 20 includes an auto-ignition index calculating unit 21 for calculating an auto-ignition index K0 which is calculated based on the cylinder temperature and pressure in the combustion chamber 3, and which indicates easiness of occurrence of auto-ignition of fuel at a crank angle that is before an ignition timing in a compression stroke.

The auto-ignition index calculating unit 21 calculates the auto-ignition index K0 in accordance with a prediction formula configured by the Livengood-Wu integral expression indicated by:

$$K0 = \int_{IC}^{CA} \left(\frac{1}{\tau}\right) dt$$

$$\tau = AP^{-n}\exp(B/T)$$

where IC represents the timing when the intake valve is closed, CA represents a crank angle which is before a preset ignition timing, A, B, and n represent parameters related to the fuel, P represents the pressure at each crank angle, and T represents the temperature at each crank angle. The terminal point of the integration interval of the prediction formula, i.e., CA (the crank angle which is before the ignition timing) may be considered to be set to the terminal point of the range where there is a possibility of occurrence of low-speed pre-ignition, i.e., a crank angle immediately before the ignition timing.

Here, the auto-ignition index calculating unit 21 may employ another prediction formula in which at least the cylinder temperature and pressure in the combustion chamber 3 are used as calculation elements.

The electronic control unit 20 further includes a first correction coefficient calculating unit 22 which calculates a wall-adhering fuel correction coefficient C1 used for correcting the auto-ignition index, based on the amount of fuel adhering to the wall surface of the combustion chamber 3 at a crank angle that is before the ignition timing in the compression stroke.

A low-speed pre-ignition predicting unit 23 included in the electronic control unit 20 predicts whether low-speed pre-ignition occurs or not, based on a first amended auto-ignition index K1 which is calculated by using the auto-ignition index K0 and wall-adhering fuel correction coefficient C1 that are described above.

Namely, the first amended auto-ignition index K1 is indicated by:

$$K1 = K0 \times C1 = \int_{IC}^{CA} \left(\frac{1}{\tau}\right) dt \times C1$$

If the first amended auto-ignition index K1 is equal to or larger than a predetermined value, it is predicted that low-speed pre-ignition occurs during a period extending to a predetermined ignition timing in the compression stroke (i.e., a crank angle CA which is before an ignition timing that is preset in the prediction formula, and the same shall apply hereinafter). If the first amended auto-ignition index K1 is smaller than the predetermined value, it is predicted that low-speed pre-ignition does not occur during the period extending to the ignition timing in the compression stroke. In the case where occurrence of low-speed pre-ignition is predicted based on a second amended auto-ignition index K2 which will be described later, the prediction of occurrence of low-speed pre-ignition which is based on the first amended auto-ignition index K1 may be omitted.

Even in the case where occurrence of low-speed pre-ignition is not predicted based on the value of the auto-ignition index K0, when the fuel adhering amount is increased, usually, the occurrence rate of low-speed pre-ignition tends to increase. Therefore, the concept of the wall-adhering fuel correction coefficient C1 by which the auto-ignition index K0 is corrected is introduced.

Here, for example, P (the pressure at each crank angle) and T (the temperature at each crank angle) can be calculated from an equation of state based on the amount of air intaken into the combustion chamber 3, and the cylinder temperature and pressure at IC (the timing when the intake valve is closed).

As shown in the map diagram of FIG. 3A, for example, the fuel adhering amount which forms the basis for the calculation of the wall-adhering fuel correction coefficient C1 can be estimated from the fuel injection timing indicated on the abscissa (expressed by a crank angle before the compression top dead center), and the cooling medium temperature of the engine (temperature of cooling water of the engine) indicated on the ordinate. The wall-adhering fuel correction coefficient C1 is adequately set for each of thus estimated fuel adhering amounts a to n. The map diagram of FIG. 3A is set for a specific intake air temperature. Map diagrams for other intake air temperatures are separately set. The intervals of intake air temperatures which are used for setting map diagrams may be set in an arbitrary manner, such as every 1° C. or every 5° C.

In the case where, as shown in the map diagram of FIG. 3B, the amount of fuel adhering to the wall surface of the combustion chamber 3 at a specific crank angle is already predicted, alternatively, the wall-adhering fuel correction coefficient C1 for correcting the auto-ignition index K0 may be set based on thus predicted fuel adhering amounts a to k. The wall-adhering fuel correction coefficient C1 is a coefficient which is 1 in the case where the fuel adhering amount is zero. In the case where any amount of fuel adheres to the wall surface, therefore, the coefficient has a numerical value of 1 or more.

In the case where the prediction of occurrence of low-speed pre-ignition is to be performed more correctly, a concept of an intake oxygen concentration correction coefficient C2 is introduced.

In a controlling apparatus in which the concept of the intake oxygen concentration correction coefficient C2 is introduced, the electronic control unit 20 includes a second correction coefficient calculating unit 24 which calculates the intake oxygen concentration correction coefficient C2 for correcting the first amended auto-ignition index K1, based on the rate of the recirculation gas in the air intaken into the combustion chamber 3.

As shown in the map diagram of FIG. 3C, for example, the intake oxygen concentration correction coefficient C2 can be calculated as a to z shown in the figure, based on the rate of the recirculation gas in the air intaken into the combustion chamber 3. The intake oxygen concentration correction coefficient C2 is a coefficient which is 1 in the case where the intake air does not contain recirculation gas. Therefore, the larger the amount of recirculation gas contained in the intake air, the smaller the coefficient is, and the coefficient has a numerical value which is equal to or smaller than 1 and equal to or larger than 0.

Then, the low-speed pre-ignition predicting unit 23 included in the electronic control unit 20 predicts whether low-speed pre-ignition occurs or not, based on the second amended auto-ignition index K2 which is calculated from the first amended auto-ignition index K1 and the intake oxygen concentration correction coefficient C2.

Namely, the second amended auto-ignition index K2 is indicated by:

$$K2 = K1 \times C2 = \int_{IC}^{CA} \left(\frac{1}{\tau}\right) dt \times C1 \times C2$$

If the second amended auto-ignition index K2 is equal to or larger than a predetermined value, it is predicted that low-speed pre-ignition occurs during a period extending to a predetermined ignition timing in the compression stroke. If the second amended auto-ignition index K2 is smaller than the predetermined value, it is predicted that low-speed pre-ignition does not occur during the period extending to the ignition timing in the compression stroke.

When the rate of the recirculation gas is increased and the concentration of oxygen in the intake air is decreased, usually, a phenomenon in which the gas mixture does not ignite and the occurrence rate of low-speed pre-ignition is lowered tends to occur. Therefore, the concept of the intake oxygen concentration correction coefficient C2 by which the first amended auto-ignition index K1 is corrected based on the rate of the recirculation gas in the air intaken into the combustion chamber 3 is introduced.

The above-described predetermined value related to the first amended auto-ignition index K1, and that related to the second amended auto-ignition index K2 may be equal to each other or different from each other.

The low-speed pre-ignition predicting unit 23 included in the electronic control unit 20 further predicts whether low-speed pre-ignition occurs or not, based on a third amended auto-ignition index K3 which is calculated by using the auto-ignition index K0 and the intake oxygen concentration correction coefficient C2.

The third amended auto-ignition index K3 is calculated by using the auto-ignition index K0 and the intake oxygen concentration correction coefficient C2, and indicated by:

$$K3 = K0 \times C2 = \int_{IC}^{CA} \left(\frac{1}{\tau}\right) dt \times C2$$

In the case where the both predetermined values respectively related to the first amended auto-ignition index K1 and the second amended auto-ignition index K2 are equal to each other, the predetermined value related to the third amended auto-ignition index K3 may be equal to or different from the both predetermined values. In the case where the both predetermined values are different from each other, the predetermined value may be equal to one of the both predetermined values, or different from the both predetermined values.

When occurrence of low-speed pre-ignition is predicted as a result of evaluations of the first amended auto-ignition index K1, the second amended auto-ignition index K2, and the third amended auto-ignition index K3, a low-speed pre-ignition avoidance controlling unit 25 included in the electronic control unit 20 performs a control for avoiding the occurrence of low-speed pre-ignition.

As the control for avoiding occurrence of low-speed pre-ignition, in order to avoid occurrence of low-speed pre-ignition, for example, a control may be performed in which the cylinder temperature or the cylinder pressure is lowered, in which the fuel injection timing in the compression stroke is delayed, or in which the fuel injection timing in the intake stroke is advanced. In the case where a plurality of fuel injection valves 15 are provided to one cylinder, in order to avoid occurrence of low-speed pre-ignition, alternatively, a control may be performed in which the amount of fuel injected by one of the fuel injection valves 15 that injects the fuel in a manner that a relatively larger amount of fuel adheres to the wall surface of the combustion chamber 3 is decreased, and that of fuel injected by a fuel injection valve 15 that injects the fuel in a manner that a relatively smaller amount of fuel adheres to the wall surface of the combustion chamber 3 is increased.

Specifically, a situation is assumed where the auto-ignition index K0 and the third amended auto-ignition index K3 are not increased to the respective predetermined values or larger, and the first amended auto-ignition index K1 and the second amended auto-ignition index K2 are increased to the respective predetermined values or larger. That is, a case where the indexes are increased to the respective predetermined values or larger, only by considering the wall-adhering fuel correction coefficient C1 is assumed.

In this case, a control for reducing adhesion of fuel to the wall surface of the combustion chamber 3 is performed. The control may be realized by one of or any combination of the above-described controls in which the cylinder temperature or the cylinder pressure is lowered, in which the fuel injection timing in the compression stroke is delayed, and in which the fuel injection timing in the intake stroke is advanced, and a control in which the injection ratios of the plurality of fuel injection valves 15 are controlled. A control for increasing the number of revolutions of the engine is performed during the control for reducing the adhering amount.

Next, a case where the third amended auto-ignition index K3 is equal to or larger than the corresponding predetermined value is assumed. In contrast to the wall-adhering fuel correction coefficient C1 which has a value of 1 or more, the intake oxygen concentration correction coefficient C2 has a value which is equal to or smaller than 1 and equal to or larger than 0. When the third amended auto-ignition index K3 is equal to or larger than the corresponding predetermined value, therefore, it is considered that, in the case where the predetermined values respectively corresponding to the indexes K1, K2, and K3 are made equal to one another, the evaluation based on the first amended auto-ignition index K1, and that based on the second amended auto-ignition index K2 exceed the respective predetermined values. Even when the preset predetermined values are different from one another, alternatively, it is considered that the case where the indexes K1 and K2 exceed the respective predetermined values often occurs. Therefore, the control for avoiding the occurrence of low-speed pre-ignition must be performed at an early timing. As a control for avoiding this, here, a control for reducing the cylinder temperature and the cylinder pressure is performed.

For example, a technique for reducing the cylinder temperature and the cylinder pressure may be realized by one of or a combination of: a control of making the intake air-fuel ratio rich; and, in the case of an engine including a supercharger, a control in which the boost pressure is lowered by a waste gate valve and the like, in the case of an engine including a variable valve mechanism, that in which timings of opening and closing the intake valves and the exhaust valves are adjusted, and the pressure of the intake air is lowered, and, in the case of an engine including an electronic control type throttle valve, that in which the pressure of the intake air is lowered by closing the throttle valve.

In the case where a control other than the control of making the intake air-fuel ratio rich is performed, there is a possibility that the torque of the engine is lowered. Therefore, it is preferable to preferentially perform the control of making the intake air-fuel ratio rich. The control of making the intake air-fuel ratio rich is performed, and, during the rich control, the control for increasing the number of revolutions of the engine is conducted. According to the control, it is possible to prevent harmful components contained in exhaust gas from being increased.

In the embodiment, as the fuel injection valve 15, two in-cylinder injection valves (direct injection valves) which directly inject the fuel into the combustion chamber 3 are employed for the one cylinder. Alternatively, one of the two in-cylinder injection valves may be replaced with a port injection valve which injects the fuel into the intake passage 4.

In the intake passage 4 communicating with the combustion chamber 3, the port injection valve is directed toward the rear surfaces of the heads of the intake valves 6(6*a*, 6*b*). When the intake valves 6(6*a*, 6*b*) are opened, part of the injected fuel reaches the cylindrical wall surface of the combustion chamber 3. When the piston 2 is in the vicinity of the top dead center, part of the fuel is directed to the top surface of the piston 2. However, the amount of fuel which is injected by the port injection valve, and which adheres to the wall surface of the combustion chamber 3 is considerably smaller than that of fuel which is injected by the in-cylinder injection valve, and which adheres to the wall surface of the combustion chamber 3.

In the low-speed pre-ignition avoiding control, in order to avoid occurrence of low-speed pre-ignition, therefore, a control may be performed in which the amount of fuel injected by the in-cylinder injection valve injecting a relatively larger amount of fuel adhering to the wall surface of the combustion chamber 3 is decreased, and that of fuel injected by the port injection valve injecting a relatively smaller amount of fuel adhering to the wall surface of the combustion chamber 3 is increased.

The prediction of occurrence of low-speed pre-ignition, and the control for avoiding low-speed pre-ignition which is performed after the prediction are effective in a region where the number of revolutions of the engine is about 3,000 or less.

Although the above-described embodiment has the configuration where the two intake valves 6 and the two exhaust valves 7 are disposed in one cylinder, the number of the valves can be arbitrarily set.

Although, in the embodiment, the configuration of the invention has been described by exemplifying a four-cycle gasoline engine for an automobile, the invention can be applied also to engines of other types in which there is a possibility of occurrence of low-speed pre-ignition.

The controlling apparatus of the invention includes: an auto-ignition index calculating unit which calculates an auto-ignition index which is calculated based on a cylinder temperature and pressure in a combustion chamber, the auto-ignition index indicating easiness of occurrence of auto-ignition of fuel at a crank angle that is before an ignition timing in a compression stroke; a first correction coefficient calculating unit which calculates a wall-adhering fuel correction coefficient that is used for correcting the auto-ignition index based on an amount of fuel adhering to a wall surface of the combustion chamber; and a low-speed pre-ignition predicting unit which predicts occurrence of low-speed pre-ignition based on the auto-ignition index and the wall-adhering fuel correction coefficient. Therefore, the controlling apparatus can predict more surely occurrence of low-speed pre-ignition in the combustion chamber.

What is claimed is:

1. A control device for an engine, the engine that includes: a piston accommodated in a cylinder; an intake valve disposed in an opening of an intake passage which communicates with a combustion chamber of the cylinder; an exhaust valve disposed in an opening of an exhaust passage which is drawn out from the combustion chamber; a fuel injection valve which is configured to inject fuel into the combustion chamber or the intake passage; and an ignition device disposed in the combustion chamber, the control device comprising:

a processor configured to operate:

an auto-ignition index calculator that is configured to calculate, based on a cylinder temperature and a cylinder pressure in a combustion chamber, an auto-ignition index which indicates easiness of occurrence of auto-ignition of fuel at a crank angle before an ignition timing in a compression stroke;

a first correction coefficient calculator that is configured to calculate, based on an estimated amount of fuel adhering to a wall surface of the combustion chamber at the crank angle, a wall-adhering fuel correction coefficient for correcting the auto-ignition index; and a low-speed pre-ignition predictor that is configured to predict, based on the auto-ignition index and the wall-adhering fuel correction coefficient, occurrence of low-speed pre-ignition.

2. The control device according to claim 1, wherein the amount of fuel adhering to the wall surface is estimated from a fuel injection timing and a cooling medium temperature or intake air temperature of the engine.

3. The control device according to claim 1, wherein the engine further includes an exhaust gas recirculation apparatus which is configured to introduce part of exhaust gas in the exhaust passage, as recirculation gas into intake air, the processor further operates as a second correction coefficient calculator that is configured to calculate, based on a rate of the recirculation gas in the intake air to the combustion chamber, an intake oxygen concentration correction coefficient for correcting the auto-ignition index, and the low-speed pre-ignition predictor is configured to predict the occurrence of the low-speed pre-ignition based on the auto-ignition index and the intake oxygen concentration correction coefficient.

4. The control device according to claim 3, wherein the low-speed pre-ignition predictor is configured to predict the occurrence of the low-speed pre-ignition based on an amended auto-ignition index which is calculated by using the auto-ignition index, the wall-adhering fuel correction coefficient, and the intake oxygen concentration correction coefficient.

5. The control device according to claim 1, wherein the auto-ignition index is a prediction formula configured by Livengood-Wu integral expression indicated by:

$$\int_{IC}^{CA}\left(\frac{1}{\tau}\right)dt$$

$$\tau = AP^{-n}\exp(B/T)$$

where

IC represents a timing when the intake valve is closed,

CA represents a crank angle before a preset ignition timing,

A, B, and n represent parameters related to the fuel,

P represents a pressure at each crank angle, and

T represents a temperature at each crank angle.

6. The control device according to claim 5, wherein the pressure at each crank angle and the temperature at each crank angle are calculated from an equation of state based on an amount of air intaken into the combustion chamber, and the cylinder temperature and the cylinder pressure at the timing when the intake valve is closed.

7. The control device according to claim 1, the processor further operating as:

a low-speed pre-ignition avoidance controller that, when the occurrence of the low-speed pre-ignition is predicted, is configured to perform a control for avoiding the occurrence of the low-speed pre-ignition.

8. The control device according to claim 7, wherein the low-speed pre-ignition avoidance controller is configured to perform a control in which the cylinder temperature or the cylinder pressure is lowered, or a control in which a fuel injection timing is delayed.

9. The control device according to claim 8, wherein, when the occurrence of the low-speed pre-ignition is predicted without reference to the wall-adhering fuel correction coefficient, the low-speed pre-ignition avoidance controller is configured to perform the control in which the cylinder temperature or the cylinder pressure is lowered, and, when the occurrence of the low-speed pre-ignition is predicted with reference to the wall-adhering fuel correction coefficient, the low-speed pre-ignition avoidance controlling unit is configured to perform the control in which the fuel injection timing is delayed.

10. The control device according to claim 7, wherein the cylinder includes a plurality of fuel injection valves, and the low-speed pre-ignition avoidance controller is configured to perform a control in which an amount of fuel is decreased, the fuel injected by one of the plurality of fuel injection valves that is configured to inject the fuel in a manner that a relatively larger amount of fuel adheres to the wall surface of the combustion chamber.

* * * * *